US005131542A

United States Patent [19]

Stenström

[11] Patent Number: 5,131,542

[45] Date of Patent: Jul. 21, 1992

[54] DISPLAY PACKAGE FOR TEAT CUP LINERS

[75] Inventor: Lennart Stenström, Trosa, Sweden

[73] Assignee: Alfa-Laval Agriculture Intl AB, Tumba, Sweden

[21] Appl. No.: 678,523

[22] Filed: Mar. 27, 1991

[51] Int. Cl.[5] ..... B65D 73/00

[52] U.S. Cl. ..... 206/476; 206/45.31; 206/45.19; 206/482; 206/485

[58] Field of Search ..... 206/45.14, 45.19, 45.24, 206/45.25, 45.26, 419, 420, 461, 466, 471, 476, 482, 483, 485, 486, 495, 45.33

[56] References Cited

U.S. PATENT DOCUMENTS

| | | | |
|---|---|---|---|
| D. 185,890 | 8/1959 | Barton | 206/45.19 |
| 689,667 | 12/1901 | Blakeslee | 206/476 |
| 1,367,600 | 2/1921 | Hirsch | 206/45.19 |
| 1,551,139 | 8/1925 | Dietsche, Jr. . | |
| 1,726,732 | 9/1929 | Doran | 206/485 |
| 1,779,146 | 10/1930 | Reckford | 206/476 |
| 2,505,399 | 4/1950 | Hilton . | |
| 2,582,476 | 1/1952 | Buttery | 206/45.19 |
| 2,901,100 | 8/1959 | Mueller et al. | 206/485 |
| 2,974,782 | 3/1961 | Walters . | |
| 3,822,783 | 7/1974 | Mortensen | 206/471 |
| 3,885,667 | 5/1975 | Spiegel et al. . | |
| 4,023,678 | 5/1977 | Fiedler | 206/476 |
| 4,133,427 | 1/1979 | Loomis | 206/443 |
| 4,134,493 | 1/1979 | Cech | 206/45.19 |
| 4,247,003 | 1/1981 | Jones . | |

FOREIGN PATENT DOCUMENTS

| | | | |
|---|---|---|---|
| 1431040 | 1/1966 | France | 206/485 |
| 2198466 | 3/1974 | France | 206/485 |
| 2313284 | 12/1976 | France | 206/485 |
| 2451871 | 3/1979 | France . | |
| 354231 | 11/1937 | Italy | 206/485 |

*Primary Examiner*—David T. Fidei

*Attorney, Agent, or Firm*—Hovey, Williams, Timmons & Collins

[57] ABSTRACT

A display package for a plurality of teat cup liners has a support structure (1) of a foldable sheet material comprising a plane wall portion (2), and a support flap (3), which hangs together with the wall portion (2) and is folded substantially transverse to the latter, the support flap (3) being provided with a plurality of recesses (12) situated aligned with each other. Each recess (12) has an extension, which is larger than the diameter of the tubular portion (2)5 of the teat cup liner, but less than the diameter of the head portion (26) of the teat cup liner. The tubular portions (25) of the teat cup liners extend through the recesses (12) and along the wall portion (2) substantially parallel with each other, so that the teat cup liners are supported by the support flap (3) and the wall portion (2), the head portions (26) abutting against the support flap (3). A transparent plastic foil (28) encloses the support structure (1) and the teat cup liners (25), the plastic foil being stretched against these, so that the support structure and the teat cup liners are kept fixed against each other by the plastic foil.

7 Claims, 3 Drawing Sheets

DISPLAY PACKAGE FOR TEAT CUP LINERS

BACKGROUND OF THE INVENTION

1. Field of the Invention

The present invention relates to a display package for a plurality of teat cup liners, the package containing preferably four liners. Each teat cup liner has an elongated tubular portion, which at one end adjoins a short head portion. The short head portion presents a substantially larger transversal extension or outside diameter than the tubular portion.

2. Description of the Prior Art

Conventionally, newly manufactured teat cup lines are usually packed in transparent plastic bags in batches of four teat cup liners. Such plastic bags are cheap in price, protect the teat cup liners against dirt and, to some extent, allow the teat cup liners packed therein to be displayed for inspection without the necessity of opening the bags. However, teat cup liners packed in bags have the disadvantage that they are completely unprotected against loads during transport and storage of the filled bags, which often gives rise to permanent deformations of the teat cup liners. Such deformations, especially if they occur on the thin wall parts of the teat cup liner which are subjected to pulsating pressure, may jeopardize the function of the teat cup liners during milking. In addition, visible deformations on the teat cup lines, even if they are harmless per se, can result in purchase resistance by the consumer.

Another disadvantage of teat cup liners packed in bags is that it is difficult for the consumer to quickly identify bags containing the required teat cup liners. The bags with teat cup liners are often exposed in the shop among other similar bags containing other articles, and the shapeless bag material forms irregular small creases. The creases give rise to reflections, so that the view into the bags is obstructed.

Some newly manufactured teat cup liners are also packed in cartons, which completely enclose the teat cup liners. Such cartons efficiently protect the teat cup liners against loads during transport and storage of the filled cartons. However, cartons are expensive, identify the teat cup liners poorly and prevent inspection of the packed teat cup liners in unopened cartons. It is true that the cartons could be provided with windows of transparent plastic for displaying the contents, but this would raise the price of the cartons even further, without providing significant improvements in visibility of the contents.

SUMMARY OF THE INVENTION

The present invention provides a new display package of the kind herein presented, which efficiently exposes and identifies the teat cup liners, protects them against point loads and permanent deformations during transport and storage, allows inspection of the packed teat cup liners without the need for opening the display package, and is relatively inexpensive.

The present invention also provides a new display package with an attractive, distinctive, and sales promoting appearance.

Thus, the invention hereof provides a display package of the kind initially stated, comprising a support structure of a foldable sheet material having a plane wall portion and a support flap. A support flap fold hinges the support flap together with an edge of the wall portion and is folded substantially transverse to the wall portion. The support flap is provided with a plurality of recesses aligned with each other along the wall portion principally parallel to said edge, each recess having an extension. The extension is larger than the transversal extension (outside diameter) of the head portion of the teat cup liner. The tubular portions of the teat cup liners extend through the recesses and along the wall portion substantially parallel to each other, so that the teat cup liners are supported by the support flap. The head portions of the teat cup liners abut against the outside of the folded support flap. A transparent plastic foil encloses the support structure and the teat cup liners. The plastic foil is stretched against the support structure and the teat cup liners to fix these two against each other.

The fragile portions of the teat cup liners are thus advantageously and satisfactorily protected against loads during transport and storage of the display packages. Since the teat cup liners are kept fixed side by side against the protecting wall portion and the support flap, the teat cup liners, the support structure and the plastic foil cooperate, so that the package will be particularly stiff and resistant to loads. In addition, the advantage is obtained that the teat cup liners can be inspected satisfactorily through the stretched plastic foil without the disturbing small reflections which normally obstruct the view into ordinary transparent bags. The arranged localization of the teat cup liners side-by-side and enclosed by the stretched transparent plastic foil also creates a clear field of vision for the presumptive buyer, who may quickly identify the contents and attractive appearance of the display package. Another advantage of the new display package is that the end surfaces of the head portions of the packed teat cup liners can be utilized as supporting surfaces, so that the display packages can be put directly on shelves with the contents well exposed.

During the manufacture of teat cup liners, the removal of so-called burrs is the last step of the manufacturing process. The burrs arise during the molding of the teat cup liners. Thereafter, the teat cup liners are packed. The removal of burrs is attended by one operator while another operator attends to the packing of the finished teat cup liners. The support structure of the new display package may advantageously be utilized as part of a transport device in such a way that the same operator, who feeds the machine for removal of burrs, also suspends the finished teat cup liners with the head portion upward in the recesses of the support flaps of the support structures. A transport device brings the support structures to a convenient vicinity of the last mentioned operator. Filled support structures can then be transported by the transport device directly to a machine for application of the transparent plastic foil. This process will save one operator, and the production cost of the display package will thereby be reduced.

The support flap is suitably limited outward from the wall portion by an edge, which is broken by each recess. The operator can easily insert the tubular portions of the teat cup liners into the recesses by moving the teat cup liners sideways substantially transverse to the wall portion. (Alternatively, an operator may move the tubular portions axially into the recesses. In this case the recesses may suitably be constituted by holes.)

To prevent the teat cup liners, which have been fitted in the recesses of the support flap, from loosening from the support flap before the teat cup liners and the support structure have been provided with the plastic foil, each recess in the vicinity of the edge of the support flap is suitably formed with an extension parallel to the support flap fold. The support flap fold is less than the transversal extension or outside diameter of the tubular portion of each teat cup liner in the vicinity o the head portion of the teat cup liner.

In accordance with a preferred embodiment of the display package hereof, the support flap is formed with an extension which is limited in distance from the wall portion such that the support flap, at least between the outermost situated teat cup liners, is spaced from the plastic foil. Hereby, the plastic foil creates aesthetically attractive unbroken saddle surfaces between adjacent head portions.

Preferably, the support structure forms guide flaps which hinge together with the wall portion and are folded outward from the latter. The guide flaps abut against mutual sides of the tubular portion of each teat cup liner, so that the teat cup liners are fixed laterally.

DESCRIPTION OF THE PREFERRED EMBODIMENT

Figure 1:
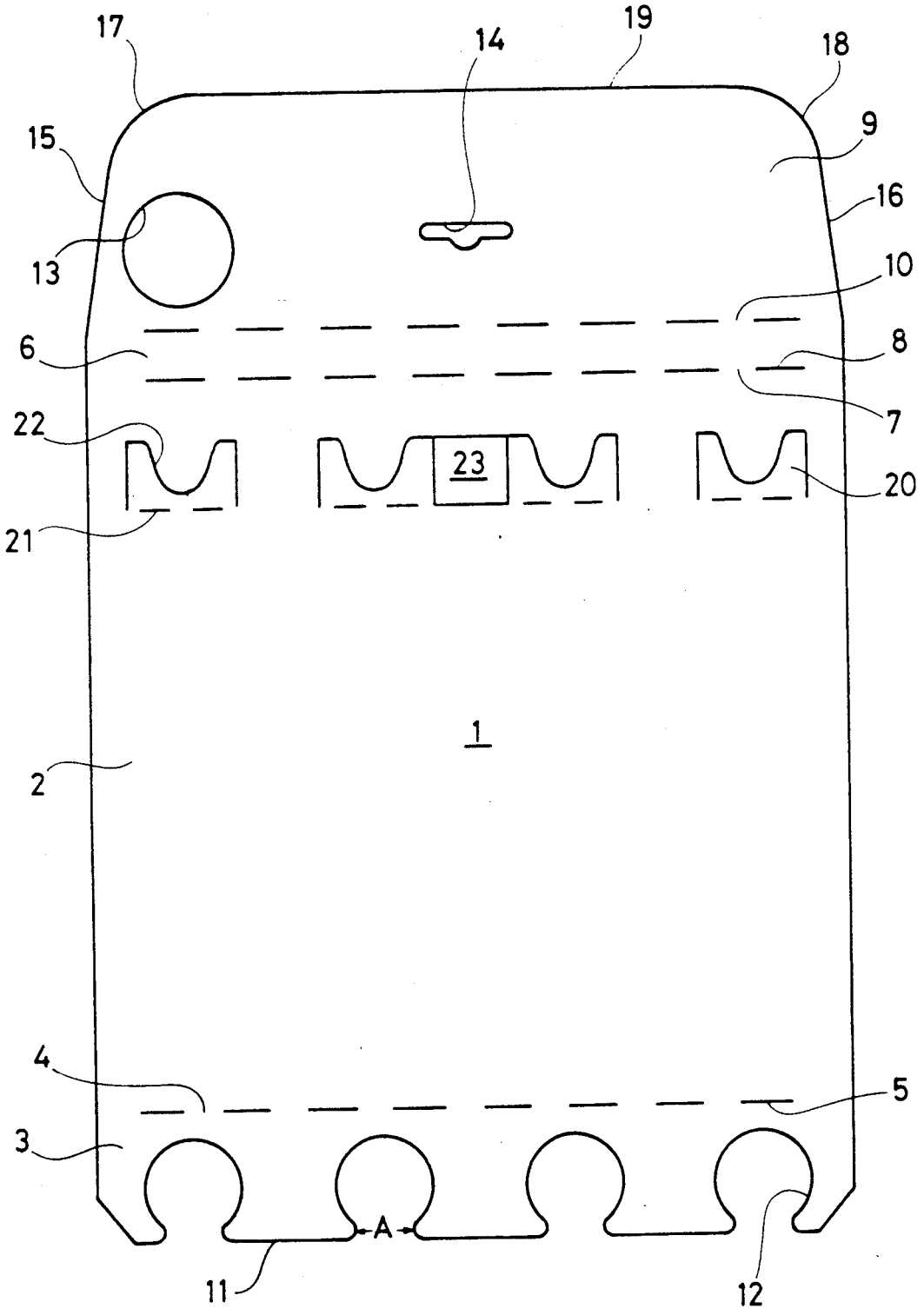
FIG. 1 is a front elevational view of the support structure of the present invention in unfolded presentation.

The unfolded support structure 1, shown in FIG. 1, consists of a carton material and comprises a rectangular wall portion 2, a rectangular support flap 3, a straight support flap fold 4, which hinges rectangular support flap 3 together with an edge 5 of the rectangular wall portion 2, a rectangular end flap 6, a straight end flap fold 7, which is parallel to the support flap fold 4 and hinges rectangular end flap 6 together with an edge 8 of the wall portion 2, and a display flap 9 for presenting information. The display flap 9 is hinged together with the end flap 6 by a display flap fold 10 oriented parallel to the end flap fold 7. By the expression "fold" used herein, it is intended that a fold line is defined in the support structure formed by either indentations in the carton material, or perforations therein, or a combination of indentations and perforations thereby defining a line of weakening.

The support flap 3 has an edge 11 which extends parallel to the support flap fold 4 in which is broken by four recesses 12 in the support flap 3. The recesses 12 are aligned with each other at the same distance from the edge 5 of the wall portion and have a substantially circular shape. Each recess 12 has an opening A in the vicinity of the edge 11 of the support flap which is less than the diameter of the recess. The two corners of the support flap 3 at the edge 11 are beveled.

The display flap 9 is provided with a circular hole 13, situated longitudinally in line with one of the outer most recesses 12 in the support flap 3. The circular hole is in a direction transverse to the edges 5 and 8. A suspension hole 14 is centrally located in the display flap 9. The display flap 9 is formed with two short side edges 15 and 16, which extend convergingly towards one another from the end flap 6. The display flap 9 adjoins a long side edge 19 via curved edge portions 17 and 18. The long side edge 19 extends parallel to the display flap fold 10.

In the vicinity of the edge 8 of the wall portion 2 are located four guide flaps 20 cut in the wall portion 2. The guide flaps 20 are situated longitudinally in line with respective recesses 12, and thus in a direction transverse to the edge 5. The guide flaps are hinged together with the wall portion 2 via folds 21 which extend in parallel orientation to the support flap fold 4. Each guide flap is formed with an edge 22 which forms a recess for reception of a teat cup liner when the guide flap 20 is folded outward from the wall portion 2.

A hole 23 is provided between the two middle guide flaps 20 for reception of a suspension hook.

Figure 2:
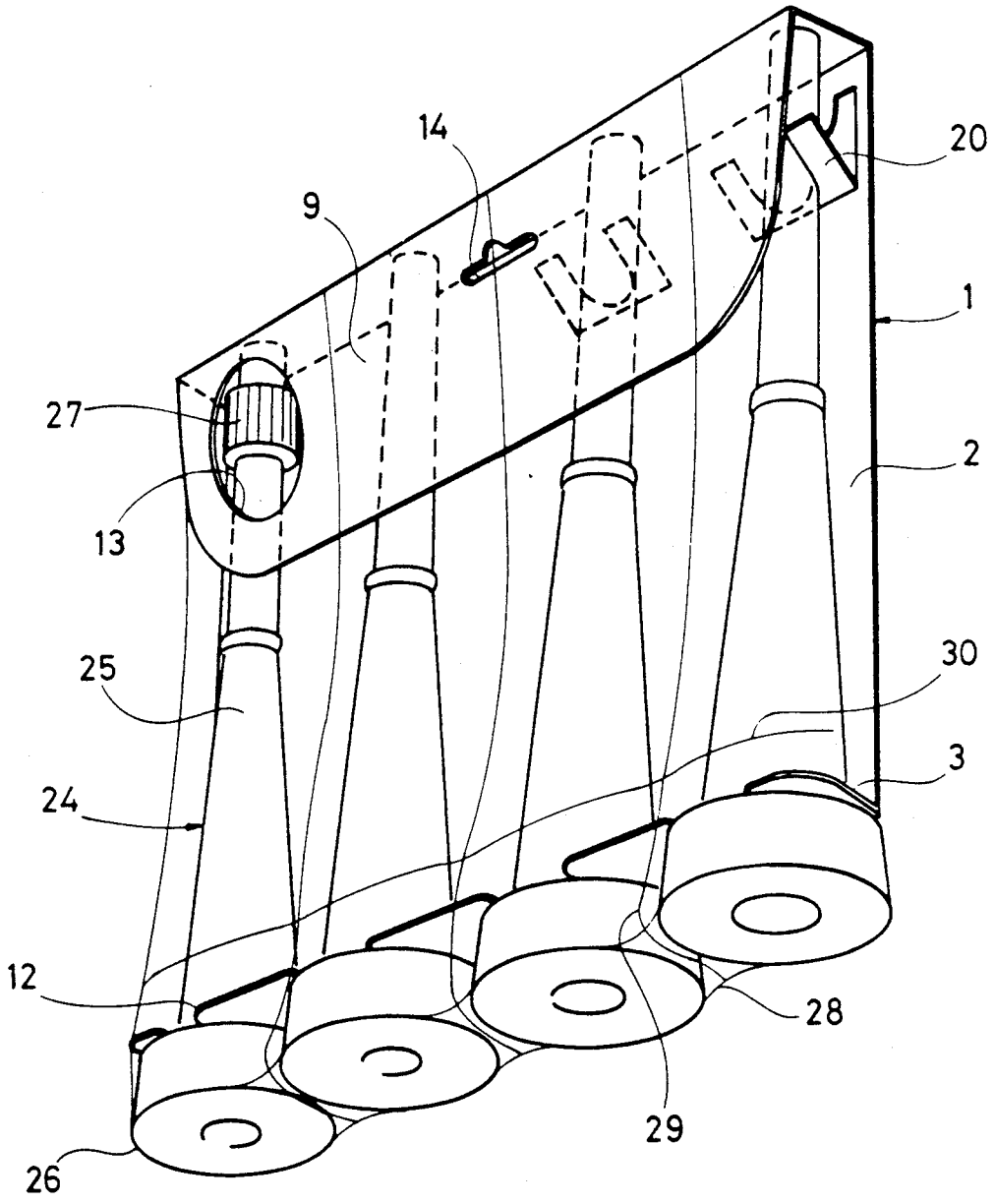
FIG. 2 is a perspective view of the display package of the present invention in folded presentation.

Turning now to FIG. 2, teat cup liners 24 having an elongated tubular portion 25 with a circular cross-section which at one end adjoins a short head portion 26 with a circular cross-section and with a substantially larger diameter than the tubular portion 25 is shown in packed orientation.

The teat cup liners 24 are inserted into the recesses 12 with the support flap 3 in a folded state substantially transverse to the wall portion by displacing the teat cup liner sideways substantially transverse to the wall portion 2. Thereby, each recess 12 is shaped with an extension, which is larger than the diameter of the tubular portion 25 of the teat cup liner but less than the diameter of the head portion 26 of the teat cup liner. The distance A of each recess 12 is less than the diameter of each tubular portion 25 in the vicinity of the head portion 26. The tubular portions 25 of the teat cup liners extend through the recesses 12 and along the wall portion 2, the head portions 26 abutting against the support flap 3.

The guide flaps 20 are shown folded outwardly from the wall portion 2 so that the tubular portions 25 abut against the edges 22, and whereby the portions 25 are laterally fixed. Only two of the four guide flaps 20 are shown in FIG. 2.

The end flap 6 and the display flap 9 are folded so that the display flap 9 extends from the end flaps 6 a distance across the teat cup liners. However, the display flap 9 is dimensioned such that a substantial part of the teat cup liners 24 are not covered by the display flap 9.

In the event the teat cup liners are of the kind which comprise a radially enlarged portion 27 in the vicinity of the headless end of the teat cup liner, such a portion 27 of one of the teat cup liners will be exposed through the recess 13 in the display flap 9. In this case, the guide flaps 2 can suitably be placed inside and against the enlarged portion 27, such that they fix the teat cup liners sideways as well as lengthwise.

A transparent plastic foil 28 encloses completely the support structure 1 in the teat cup liners 24. The plastic foil 28 is shrunk so that it is tightened around the support structure and the teat cup liners 24. Thus, these are fixed relative to one another. Alternatively, on application, the plastic foil may be stretched about the support structure 1 and the teat cup liners 24 instead of being shrunk. The plastic foil, thus tightened, creates aesthetically attractive curved surfaces, which substantially lack reflection creating creases. Thereby, the teat cup liners 24 are clearly exposed. The support flap 3 is also formed with such a limited extension from the wall portion 2 that the support flap 3 between the teat cup liners 24 does not abut with the edge 11 against the plastic foil 28. The plastic foil 28 thereby forms unbroken saddle shaped surfaces (shown in FIG. 2 by means of the lines 29 and 30) between adjacent head portions 26.

The display package shown in FIG. 2 may additionally be stiffened by means of side flaps in an alternative embodiment, which are arranged together with the edges of the wall portion 2. The side flaps extend parallel to the teat cup liners. Such side flaps are to be folded outward from the wall portion 2 toward the teat cup liners and suitable attached to the support flap 3 in the end flap 6 by, for example, locking tabs or by glue. Such an arrangement of side flaps results in improved stiffening of the display package and improved protection of the teat cup liners against exterior loads, but also reduces exposure of the teat cup liners and provides for a more expensive package.

Figure 3:
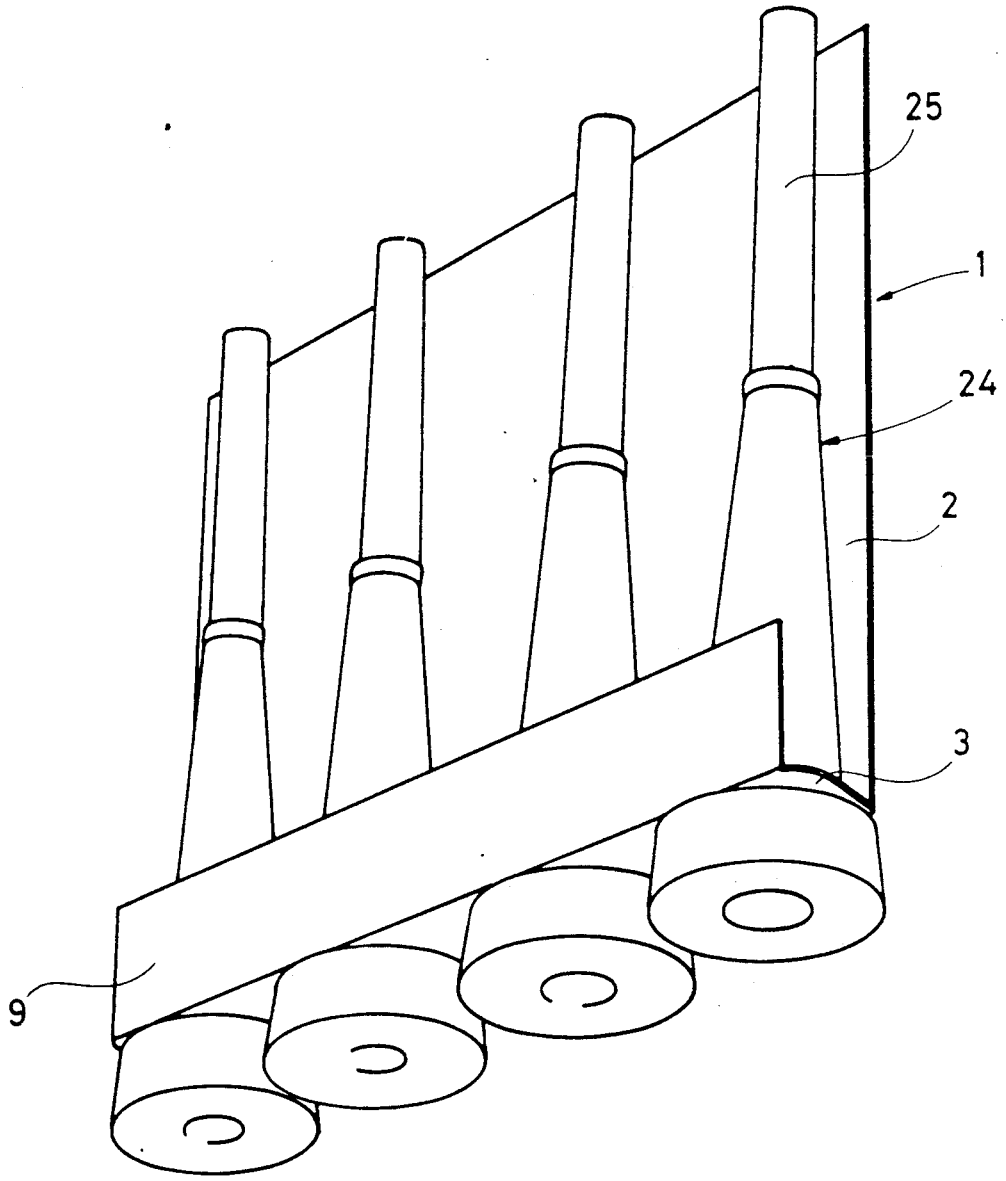
FIG. 3 is a perspective view of an alternative embodiment of the present invention.

An alternate embodiment of the display package hereof useful for displaying teat cup liners 24 of the same kind as shown in FIG. 2 is shown in FIG. 3. It is to be understood that this display package is also provided with a plastic enclosure, although it is not shown in the figure. The support structure 1 in this embodiment has a support flap 3, which is provided with recesses 12 in the form of holes with a closed outline. When packing the teat cup liners 24, the tubular portions of the teat cup liners are inserted through these holes. By forming the display package in this way, the dis-play flap 9 may be arranged hinged to the support flap 3, with the display flap 9 being folded against the tubular portion 25 of the teat cup liners 24. A saving in material can thereby be made corresponding to the end flap 6 shown in FIG. 1. Of course, this display flap 9 may be combined with, and supplemented by a display flap of the kind shown in FIGS. 1 and 2.

I claim:

1. A display package for a plurality of teat cup liners, each teat cup liner having an elongated tubular portion, which at one end adjoins a short head portion presenting a substantially larger transversal extension than the tubular portion, said display package comprising:

a support structure formed of a foldable sheet material having a plane wall portion, and a support flap joined with the wall portion along a line of weakness defining a support flap fold whereby said support flap is folded substantially transverse to the wall portion, the support flap being provided with a plurality of recesses aligned with each other along the wall portion substantially parallel to an end edge, each recess having an extension which is larger than the transversal extension of the tubular portion in the vicinity of the had portion of a teat cup liner received therein, but less than the transversal extension of the head portion of the teat cup liner received therein, the tubular portions of the teat cup liner received therein extending through the recesses and along the wall portion substantially parallel to each other, so that the teat cup liners received in said recesses are supported by said support flap and said wall portion, the head portions of the teat cup liners received in said recesses being positioned in abutting relationship against the outside of the folded support flap; and a transparent plastic foil completely enclosing the support structure and the teat cup liners received i said recesses, the plastic foil being sized, configured and oriented for being stretched against the support structure and the teat cup liners received in said recesses, whereby the support structure and the teat cup liners received in said recesses are kept fixed against each other by said plastic foil.

2. A display package in accordance with claim 1, wherein said support flap is limited outwardly from said wall portion by an edge which is broken by each recess, the tubular portions of the teat cup liners received in said recesses being insertable into said recesses by displacing the teat cup liners laterally substantially transversely to said wall portion.

3. A display package in accordance with claim 2, wherein each of said recesses is formed with an extension oriented parallel to said support flap fold proximate to said edge of said support flap, said extension of each recess being of a dimension less than the transversal extension of the tubular portion in the vicinity of the head portion of each teat cup liner received in said recesses.

4. A display package in accordance with claim 3, wherein said support flap is formed with such a limited extension from said wall portion that the support flap, at least between the outermost situated teat cup liners received in said recesses, is spaced from said plastic foil, whereby the plastic foil forms unbroken saddle surfaces between adjacent head portions.

5. A display package in accordance with claim 4, wherein said support structure forms a plurality of guide flaps, said guide flaps being hinged with the wall portion and folded outwardly therefrom to abut against mutual sides of the tubular portion of each teat cup liners received in said recesses, whereby said teat cup liners received in said recesses are fixed laterally.

6. A display package in accordance with claim 5, wherein said support structure includes an end flap joined with a further edge of said wall portion along an end flap fold oriented parallel to said support flap fold, said end flap being folded outwardly from the wall portion towards the teat cup liners received in said recesses, said support structure further including a display flap for presenting information thereon joined to the end flap along a display flap fold oriented parallel to said end flap fold, said display flap being folded toward the teat cup liners received in said recesses.

7. A display package in accordance with claim 6, each of the teat cup liners received in said recesses being provided with a radially enlarged portion in the vicinity of a headless end thereof, wherein the display flap extends across said radially enlarged portions of the teat cup liners received in said recesses and in covering relationship thereto, said display flap including structure defining at least one recess forming a window positioned such that a radially enlarged portion of one of said teat cup liners received in said recesses is visible therethrough.

* * * * *